US007354487B2

(12) United States Patent
Dierickx et al.

(10) Patent No.: US 7,354,487 B2
(45) Date of Patent: Apr. 8, 2008

(54) COOLED AND ANNEALED BAINITE STEEL PART, AND A METHOD OF MANUFACTURING IT

(75) Inventors: Pierre Dierickx, Thionville (FR); Gaëlle Andre, Montigny les Metz (FR)

(73) Assignee: Ascometal, Courbevoie (FR)

( * ) Notice: Subject to any disclaimer, the term of this patent is extended or adjusted under 35 U.S.C. 154(b) by 0 days.

(21) Appl. No.: 10/724,641

(22) Filed: Dec. 2, 2003

(65) Prior Publication Data

US 2004/0108020 A1 Jun. 10, 2004

(30) Foreign Application Priority Data

Dec. 3, 2002 (FR) ..... 02 15226

(51) Int. Cl.

| | |
|---|---|
| ***C22C 38/16*** | (2006.01) |
| ***C22C 38/06*** | (2006.01) |
| ***C22C 38/08*** | (2006.01) |
| ***C21D 8/00*** | (2006.01) |

(52) U.S. Cl. ..... 148/328; 148/332; 148/335; 148/336; 148/624; 148/654; 148/649

(58) Field of Classification Search ..... 148/332–336, 148/622–624, 328, 654, 649, 548, 320; 420/104–116, 420/124, 89–93

See application file for complete search history.

(56) References Cited

U.S. PATENT DOCUMENTS

| | | | | |
|---|---|---|---|---|
| RE28,523 | E * | 8/1975 | Hill et al. | 420/8 |
| 5,762,725 | A | 6/1998 | Pichard et al. | |
| 6,306,527 | B1 | 10/2001 | Ikeda et al. | |
| 6,558,483 | B2 * | 5/2003 | Nakamura et al. | 148/332 |

FOREIGN PATENT DOCUMENTS

| | | |
|---|---|---|
| EP | 0 775 756 | 5/1997 |
| EP | 1 072 689 | 1/2001 |
| EP | 1 143 019 | 10/2001 |
| EP | 1 143 022 | 10/2001 |
| FR | 2 774 098 | 7/1999 |
| JP | 10-102184 | 4/1998 |
| JP | 2000-17374 * | 1/2000 |
| JP | 2001-152246 * | 6/2001 |

OTHER PUBLICATIONS

Computer-generated English translation of Japanese patent 2000-17374, Naoki Iwama, Jan. 18, 2000.*

* cited by examiner

*Primary Examiner*—Deborah Yee
(74) *Attorney, Agent, or Firm*—Wenderoth, Lind & Ponack L.L.P.

(57) ABSTRACT

The invention provides a method of fabricating a steel part, the method comprising the steps of:

preparing and casting a steel having the following composition in percentage by weight: 0.06%≦C≦0.25%; 0.5%≦Mn≦2%; traces≦Si≦3%; traces≦Ni≦4.5%; traces≦Al≦3%; traces≦Cr≦1.2%; traces≦Mo≦0.30%; traces≦V≦2%; traces≦Cu≦3.5%; and satisfying at least one of the following conditions:

0.5%≦Cu≦3.5%;

0.5%≦V≦2%:

2≦Ni≦4.5% and 1%≦Al≦2%;

the remainder being iron and impurities resulting from preparation;

hot deforming the cast steel at least once at a temperature in the range 1100° C. to 1300° C. in order to obtain a blank of the part;

controlled cooling of the blank for the part in still air or forced air; and heating the steel to perform precipitation annealing before or after machining the part from said blank.

The invention also provides a part obtained by the method.

9 Claims, No Drawings

COOLED AND ANNEALED BAINITE STEEL PART, AND A METHOD OF MANUFACTURING IT

The invention relates to metallurgy, and more precisely it relates to the field of steels for use in fabricating parts that are to withstand high levels of stress.

BACKGROUND OF THE INVENTION

Such parts are often made of steel that is quenched and annealed, or where possible, out of forged steel of ferrito-perlitic structure which is believed to offer the best technical and economic compromise, even though its mechanical performance is nevertheless limited.

Ferrito-perlitic structure steels that are often used for this purpose are of types XC70, 45Mn5, 30MnSiV6, and 38MnSiV5, and after rolling or forging they are simply subjected to in-line cooling in still air. They are thus relatively economic to produce, however their lifetime in the presence of high levels of stress is limited.

It has already been proposed to make such parts out of bainite steel using a grade of the 25MnSiCrVBS type, with cooling after forging or rolling taking place in air. Strength performance compared with the above examples is considerably improved, but nevertheless remains relatively limited compared with that which can be achieved using a steel that has been quenched and annealed.

OBJECT AND SUMMARY OF THE INVENTION

The object of the invention is to propose an association between a grade of steel and a method of fabricating a part which presents economic advantages compared with existing associations without degrading metallurgical performance, and possibly even improving such performance. A part fabricated in this way must be capable of withstanding high levels of fatigue stress. With forged parts, the fabrication method should, in particular, be adaptable to any forging line.

To this end, the invention provides a method of fabricating a steel part, the method comprising the steps of:

preparing and casting a steel having the following composition in percentages by weight: $0.06\% \leqq C \leqq 0.25\%$; $0.5\% \leqq Mn \leqq 2\%$; $traces \leqq Si \leqq 3\%$; $traces \leqq Ni \leqq 4.5\%$; $traces \leqq Al \leqq 3\%$; $traces \leqq Cr \leqq 1.2\%$; $traces \leqq Mo \leqq 0.30\%$; $traces \leqq V \leqq 2\%$; $traces \leqq Cu \leqq 3.5\%$; and satisfying at least one of the following conditions:

$$0.5\% \leqq Cu \leqq 3.5\%;$$

$$0.5\% \leqq V \leqq 2\%:$$

$$2 \leqq Ni \leqq 4.5\% \text{ and } 1\% \leqq Al \leqq 2\%;$$

the remainder being iron and impurities resulting from preparation;

hot deforming the cast steel at least once at a temperature in the range 1100° C. to 1300° C. in order to obtain a blank of the part;

controlled cooling of the blank for the part in still air or forced air; and heating the steel to perform precipitation annealing before or after machining the part from said blank.

Preferably, the steel contains five parts per million (ppm) to 50 ppm of B.

Preferably, the steel contains 0.005% to 0.04% of Ti.

If B is present, the Ti content is preferably equal to not less than 3.5 times the N content of the steel.

Preferably, the steel contains 0.005% to 0.06% of Nb.

Preferably, the steel contains 0.005% to 0.2% of S.

In which case, and preferably, the steel contains at least one of the following elements; Ca up to 0.007%; Te up to 0.03%; Se up to 0.05%; Bi up to 0.05%; and Pb up to 0.1%.

In a variant of the invention, the C content of the steel lies in the range 0.06% to 0.20%.

The Mn content of the steel then preferably lies in the range 0.5% to 1.5%, and the Cr content preferably lies in the range 0.3% to 1.2%.

The Ni content of the steel may then preferably lie in the range traces to 1%.

The Ni content of the steel may then also lie in the range 2% to 4.5%, in which case the Al content is then in the range 1% to 2%.

Precipitation annealing is generally performed preferably in the range 425° C. to 600° C.

When the steel contains 0.5% to 3.5% Cu, the precipitation annealing is preferably performed in the range 425° C. to 500° C. for a period of 1 hour (h) to 10 h.

When the steel contains 0.5% to 2% of V, the precipitation annealing is preferably performed in the range 500° C. to 600° C. for a period of more than 1 h.

When the steel contains 2% to 4.5% of Ni and 1% to 2% of Al, the precipitation annealing is preferably performed in the range 500° C. to 550° C. for more than 1 h.

Said hot deformation may be rolling.

Said hot deformation may be forging.

Preferably, the controlled cooling of the blank is performed at a rate of less than 3 degrees Celsius per second (° C./s) in the range 600° C. to 300° C.

The invention also provides a steel part obtained by the above method and which typically has a bainite microstructure, tensile strength Rm of 750 megapascals (MPa) to 1300 MPa, and a yield strength Re greater than or equal to 500 MPa.

As will have been understood, the invention consists in combining a grade of steel and a method of treatment following casting that includes a step of hot-forming the part, controlled cooling possibly being performed in still air or in forced air, and precipitation annealing preceding or following machining of the part. The composition of the steel guarantees that regardless of the way in which it is cooled, the results in terms of resistance to fatigue of parts made from said steel are suitable for satisfying user requirements.

The hot-forming operation may consist in one or more rolling operations, or in a rolling operation followed by a forging operation, or by forging alone. The essential point is that the last hot deformation of the steel should bring the steel to a temperature in the range 1100° C. to 1300° C., and that the controlled cooling should take place from that temperature.

The chemical characteristics of the steel and the heat treatment applied thereto after casting seek to obtain bainite microstructure, and also to obtain optimized mechanical characteristics. The bainite microstructure must be capable of being obtained following cooling in still air, but it must also be compatible with cooling in forced air. In this way, parts to which the invention applies can be produced on any existing installation, regardless of whether or not the installation enables forced air cooling after forging or rolling, and regardless of whether or not it allows cooling in still air. Thus, a forging installation initially designed for treating parts made of steel having a ferrito-perlitic microstructure can be used without difficulty and without special adaptation for treating parts having a bainite microstructure in accordance with the invention. Steels of bainite microstructure that have been used in the past for these purposes have required cooling under forced air and therefore have not always been suitable for being treated on installations of ordinary design.

In accordance with the invention, a steel is initially prepared of composition that is described and explained in detail below, it is then cast into ingots or continuously depending on the format of the final part, and then more generally it is rolled so as to obtain a semi-finished product.

Thereafter the semi-finished product can be subjected to a forging operation.

The last hot deformation is performed in the range 1100° C. to 1300° C. and is followed by controlled cooling in air in the heat of rolling or forging, in still air or in forced air. This provides a blank for the part.

The term "blank" is used herein to mean a bar or a semi-finished product of some other shape, from which the final part is obtained by machining, with this being independent of the form of hot deformation used: rolling, forging, or a combination thereof.

Precipitation annealing is then performed. This takes place either before or after the part is machined from said blank.

The analytic ranges required are as follows for the various chemical elements that must or that may be present (all percentages are by weight).

Carbon content lies in the range 0.06% to 0.25%. This content serves to govern the type of microstructure that is obtained. Below 0.06%, the resulting microstructure is not of interest for the intended objective. Above 0.25%, in combination with the other elements, the microstructure obtained after cooling in still air would not be sufficiently close to bainite.

The manganese content lies in the range 0.5% to 2%. When added at a concentration of more than 0.5%, this element provides a material that is suitable for quenching, and makes it possible to obtain a broad bainite range regardless of the method of cooling. However, content greater than 2% would run the risk of leading to excessive segregation.

Silicon content lies in the range traces to 3%. This element is not compulsory, properly speaking, but is advantageous in that it hardens the bainite by passing into solid solution. In addition, when copper is present in relatively large quantity, silicon serves to avoid problems associated with the presence of copper during hot forming. Nevertheless, content greater than 3% can lead to machinability problems for the material.

Nickel content lies in the range traces to 4.5%. This non-compulsory element improves quenchability and austenite stabilization. If made possible by the aluminum content, it can form precipitates of NiAl that are very hardening, thereby providing the metal with high grade mechanical characteristics. When copper is present in relatively large quantities, nickel can perform the same function as silicon. Above 4.5%, adding nickel is pointlessly expensive, given the intended metallurgical objectives.

Aluminum content lies in the range traces to 3%. This non-compulsory element is a powerful deoxidizer, and even when added in small amounts it serves to limit the quantity of oxygen that is dissolved in the liquid steel, thereby improving the inclusion purity of the part providing it has been possible to avoid excessive reoxidation during casting. As mentioned above, at high concentrations, aluminum is liable to form precipitates of NiAl if nickel is present in large quantity. There is no point in the aluminum quantity exceeding 3%.

The content of chromium, a non-compulsory element, lies in the range traces to 1.2%. Like manganese, chromium contributes to improving quenchability. Adding chromium becomes pointlessly expensive above 1.2%.

Molybdenum content lies in the range traces to 0.30%. This non-compulsory element prevents large-grained ferrite forming and makes obtaining bainite structure more reliable. Adding molybdenum above 0.30% is pointlessly expensive.

Vanadium content lies in the range traces to 2%. This non-compulsory element serves to harden the bainite by passing into solid solution. At high concentration, it also serves to obtain hardening by precipitating carbides and/or carbonitrides. Adding vanadium is pointlessly expensive above 2%.

Copper content lies in the range traces to 3.5%. This non-compulsory element can improve machineability, and by precipitating can lead to secondary hardening of the material. However, above 3.5%, it makes hot forming of the part problematic. As mentioned above, it is recommended to associate copper with a significant content of nickel or silicon in order to minimize problems of hot forming. Above 3.5%, adding copper is in any event pointlessly expensive.

Furthermore, at least one of the following three conditions must be satisfied:

copper content lying in the range 0.5% to 3.5%;

vanadium content lying in the range 0.5% and 2%; and nickel content lying in the range 2% to 4.5% and aluminum content lying in the range 1% to 2%.

The elements mentioned above are those whose metallurgical role is or can be of great importance for the invention, however other elements mentioned below may also optionally be present in order to improve certain properties of the steel.

Boron content may lie in the range 5 ppm to 50 ppm. It can improve quenchability, but it needs to be in solid solution in order to be effective. In other words, precautions may be taken to avoid that all or nearly all of the boron be in the form of boron nitrides or carbonitrides. For this purpose, it is recommended to associate adding boron with adding titanium, preferably in proportions such that $3.5 \times N\% \leqq Ti\%$. By satisfying this condition, it is possible to capture all of the dissolved nitrogen and avoid forming boron nitrides or carbonitrides. The minimum titanium content is 0.005% for the lowest nitrogen contents that are usually to be found. Nevertheless, it is advisable to ensure that the titanium content does not exceed 0.04%, since otherwise titanium nitrides of excessive size are obtained.

Titanium also serves to limit growth of austenitic grains at high temperatures, and for this purpose it may be added independently of boron at a concentration lying in the range 0.005% to 0.04%.

Niobium may also be added, at concentrations lying in the range 0.005% to 0.06%. It too can precipitate in the form of carbonitrides in austenite, thereby contributing to hardening the material.

Finally, and in conventional manner, machinability of the material can be improved by adding sulfur (in the range 0.005% to 0.2%), which can be associated with added calcium (up to 0.007%), and/or tellurium (up to 0.03%), and/or selenium (up to 0.05%), and/or bismuth (up to 0.05%), and/or lead (up to 0.1%).

Once the semi-finished product having the above-described composition has been obtained after rolling, the blank for the part is optionally subjected to forging in the usual way. It is heated to a temperature in the range 1100° C. to 1300° C. and then subjected to deformation giving rise to the blank for the part.

In the absence of forging, rolling must terminate at a temperature in the range 1100° C. to 1300° C.

Immediately after rolling, or after forging if forging is performed, the part is subjected to controlled cooling, either in still air or in forced air. In general, the part is subjected to cooling at a rate of not more than 3° C./s in the range 600° C. to 300° C.

In accordance with the invention, either before or after the machining which gives the part its final dimensions, the steel is subjected to hardening by precipitation by means of annealing, i.e. it is subjected to heat treatment following heating from a temperature equal to or slightly greater than ambient; to do this, three options are possible, and indeed they may be combined:

- copper precipitation if the copper content lies in the range 0.5% to 3.5%;
- vanadium precipitation if the vanadium content lies in the range 0.5% to 2%; and
- NiAl precipitation if nickel content lies in the range 2% to 4.5% and aluminum content lies in the range 1% to 2%.

In general, precipitation annealing is preferably performed in the range 425° C. to 600° C. However the temperature and the duration of annealing are best optimized to achieve the desired characteristics. For example, copper precipitation is preferably obtained by heat treatment in the range 425° C. to 500° C. for a period of 1 h to 10 h. Vanadium precipitation is preferably obtained by treatment in the range 500° C. to 600° C. for more than 1 h. NiAl precipitation is preferably obtained by treatment in the range 500° C. to 550° C. for more than 1 h.

Annealing may be performed as follows:

- either after machining so that the metal is not too hard during machining;
- or else after controlled cooling in air and prior to machining; machining is then performed on a part having high grade mechanical characteristics, which makes the machining particularly accurate.

Because of the annealing, it is possible to obtain high grade mechanical characteristics for the final product. Typically, traction strength Rm lies in the range 1000 MPa to 1300 MPa and the elastic limit Re is about 900 MPa or more.

Carbon content is best limited to the range 0.06% to 0.2% so as to obtain bainite of hardness limited to the range 300 Hv30 to 330 Hv30. Optimally, the manganese content should lie in the range 0.5% to 1.5%, the chromium content in the range 0.3% to 1.2%, and the nickel content can either go up to 1% if only good quenchability is required, or else can go up to 2% to 4% if it is desired to precipitate NiAl, as mentioned above. In which case, the aluminum content should lie in the range 1% to 2%.

For these steels, the traction characteristics (yield strength, strength) of the product obtained after rolling or forging and controlled cooling in air are not of particularly high grade: Typically tensile strength Rm is about 750 MPa to 1050 MPa and the yield strength Re is about 500 MPa to 700 MPa. However, these steels present good machinability.

DESCRIPTION OF EXAMPLES

As examples of implementations of the invention and a comparative example, mention can be made of the following tests.

Example 1 (Invention)

This example is representative of the variant of the invention for which it is possible to use a relatively low carbon content and in which precipitation hardening is achieved by virtue of the added copper.

The composition of the steel was as follows, expressed in $10^{-3}$% by weight:

| C | Mn | Si | S | P | Ni | Cu | Cr | Mo | Al | Ti | B | N |
|---|---|---|---|---|---|---|---|---|---|---|---|---|
| 80 | 1500 | 300 | 85 | 10 | 1500 | 2500 | 280 | 50 | 25 | — | — | 6 |

After hot forging at a temperature in the range 1250° C. to 1200° C. and after cooling in still air (mean rate of cooling in the range 700° C. to 300° C.: 1° C./s) a bainite microstructure was obtained having moderate hardness of 265 Hv30, giving strength of less than 900 MPa. With such mechanical characteristics, machinability was not a problem. Thereafter, annealing was performed at 450° C. which was maintained for a duration of 1 h, enabling strength characteristics to be increased to achieve more than 340 Hv30 for hardness and strength of 1100 MPa.

Example 2 (Invention)

This example is representative of the variant of the invention in which a relatively low carbon content can be used, and in which precipitation hardening is achieved by virtue of the added vanadium.

The composition of the steel was as follows, expressed in $10^{-3}$% by weight:

| C | Mn | Si | S | P | Ni | Cu | Cr | Mo | Al | Ti | V |
|---|---|---|---|---|---|---|---|---|---|---|---|
| 150 | 1230 | 250 | 80 | 20 | 150 | 200 | 205 | 50 | 30 | — | 820 |

After hot forging to a temperature in the range 1250° C. to 1200° C. and cooling in still air (at an average rate of 1° C./s in the range 700° C. to 300° C.) a forging having an equivalent diameter of 15 mm with a mostly bainite microstructure was obtained which was already quite hard (300 Hv30 to 320 Hv30), with strength of about 1000 MPa, which is presently the upper limit for which good machinability can still be obtained using conventional machining means. After annealing at 580° C. for 2 h, hardening by means of the vanadium enabled hardness to be obtained of about 400 Hv30, corresponding to strength greater than 1200 MPa.

Example 3 (Invention)

This example is representative of the variant invention in which a relatively low carbon content can be used, and in which hardening is achieved by precipitation of the combined nickel and aluminum additives.

The composition of the steel was as follows, expressed in $10^{-3}$% by weight:

| C | Mn | Si | S | P | Ni | Cu | Cr | Mo | Al | Ti | B | N |
|---|---|---|---|---|---|---|---|---|---|---|---|---|
| 95 | 1150 | 200 | 80 | 10 | 3000 | 206 | 220 | 60 | 1500 | — | 3 | 3 |

After hot forging at a temperature in the range 1250° C. to 1200° C. and cooling in still air (mean rate of cooling 1° C./s in the range 700° C. to 300° C.), a bainite microstructure was obtained with moderate hardness of 240 Hv30 and strength less than 800 MPa. With such mechanical characteristics, machining does not present any problem. Thereafter, annealing was performed at 520° C. and maintained for a duration of 10 h, enabling strength characteristics to be increased to reach hardness of more than 370 Hv30 and obtaining strength of about 1200 MPa.

Example 4 (Reference)

The composition of the steel was as follows, expressed in $10^{-3}$% by weight:

| C | Mn | Si | S | P | Ni | Cu | Cr | Mo | Al | Ti | V | B |
|---|---|---|---|---|---|---|---|---|---|---|---|---|
| 230 | 1500 | 700 | 80 | 11 | 150 | 150 | 800 | 70 | 20 | 25 | 190 | 3 |

After hot forging at 1250° C. to 1200° C. and cooling in still air, a part was obtained having an equivalent diameter of 25 mm and a mainly bainite microstructure with hardness close to 320 Hv30, with strength of about 1050 MPa. Annealing for 1 h in the range 300° C. to 450° C. did not enable any significant increase in strength to be obtained.

What is claimed is:

1. A method of fabricating a steel part, the method comprising the steps of:

preparing and casting a steel consisting essentially of the following composition in percentage by weight: 0.06%≦C≦0.25%; 0.5%≦Mn≦2%; traces≦Si≦3%; traces≦Ni≦4.5%; traces≦Al≦3%; traces≦Cr≦1.2%; traces≦Mo≦0.30%; traces≦V≦2%; traces≦Cu≦3.5%; 0.005%≦S≦0.2%; 5 ppm to 50 ppm of B, 0.005% to 0.04% of Ti, where the Ti content is equal to at least 3.5 times the N content of the steel;

at least one of the following elements: Ca up to 0.007%; Te up to 0.03%; Se up to 0.05%; Bi up to 0.05%; and Pb up to 0.1%, and wherein the steel satisfies at least one of the following conditions:

0.5%≦Cu≦3.5%;

2%≦Ni≦4.5% and 1%≦Al≦2%;

the remainder being iron and impurities resulting from preparation;

hot deforming the cast steel at least once at a temperature in the range 1100° C. to 1300° C. in order to obtain a blank of the part;

controlled cooling of the blank for the part in still air or forced air to obtain a bainite microstructure; and heating the steel to perform precipitation annealing before or after machining said blank, wherein part is obtained by machining, wherein the hot deformation is forging wherein the precipitation annealing is performed in the range of 425 C to 600 C for 1 h or more;

wherein when the steel satisfies the condition regarding Cu, the precipitation annealing is performed in the range of 425° C. to 500° C. for 1 h to 10 h, and when the steel satisfies the condition regarding Ni and Al, the precipitation annealing is performed in the range of 500° C. to 550° C. for more than 1 h;

wherein the controlled cooling of the blank is performed at a rate less than or equal to 3° C./s in the range of 600° C. to 300° C., wherein the part has a tensile strength Rm of 1000 MPa to 1300 MPa, and a yield strength Re of greater than or equal to 900 MPa, and wherein the bainite microstructure obtained after controlled cooling of the blank is 100% bainite.

2. A method of fabricating a steel part, the method comprising the steps of:

preparing and casting a steel consisting essentially of the following composition in percentage by weight: 0.06%≦C≦0.25%; 0.5%≦Mn≦2%; traces≦Si≦3%; traces≦Ni≦4.5%; traces≦Al≦3%; traces≦Cr≦1.2%; traces≦Mo≦0.30%; traces≦V≦2%; traces≦Cu≦3.5%; 0.005%≦S≦0.2%; 0.005% to 0.06% of Nb; 5 ppm to 50 ppm of B, 0.005% to 0.04% of Ti, where the Ti content is equal to at least 3.5 times the N content of the steel;

at least one of the following elements: Ca up to 0.007%; Te up to 0.03%; Se up to 0.05%; Bi up to 0.05%; and Pb up to 0.1%, and wherein the steel satisfies at least one of the following conditions:

0.5%≦Cu≦3.5%;

2%≦Ni≦4.5% and 1%≦Al≦2%;

the remainder being iron and impurities resulting from preparation;

hot deforming the cast steel at least once at a temperature in the range 1100° C. to 1300° C. in order to obtain a blank of the part;

controlled cooling of the blank for the part in still air or forced air to obtain a bainite microstructure; and heating the steel to perform precipitation annealing before or after machining said blank, wherein part is obtained by machining, wherein the hot deformation is forging wherein the precipitation annealing is performed in the range of 425 C to 600 C for 1 h or more;

wherein when the steel satisfies the condition regarding Cu, the precipitation annealing is performed in the range of 425° C. to 500° C. for 1 h to 10 h, and when the steel satisfies the condition regarding Ni and Al, the precipitation annealing is performed in the range of 500° C. to 550° C. for more than 1 h;

wherein the controlled cooling of the blank is performed at a rate less than or equal to 3° C./s in the range of 600° C. to 300° C., wherein the part has a tensile strength Rm of 1000 MPa to 1300 MPa, and a yield strength Re of greater than or equal to 900 MPa, and wherein the bainite microstructure obtained after controlled cooling of the blank is 100% bainite.

3. The method according to claim 1, wherein the C content of the steel lies in the range 0.06% to 0.20%.

4. The method according to claim 3, wherein Mn content of the steel lies in the range 0.5% to 1.5%, and wherein the Cr content lies in the range 0.3% to 1.2%.

5. The method according to claim 3, wherein the Ni content of the steel lies in the range traces to 1% and the steel satisfies the condition regarding Cu.

6. The method according to claim 3, wherein the Ni content of the steel lies in the range 2% to 4.5%, and wherein the Al content lies in the range 1% to 2%.

7. A steel part, obtained by the method according to claim 1.

8. The method according to claim 1, wherein the condition regarding Ni and Al is not satisfied, and therefore the steel satisfies the condition regarding Cu, and the precipitation annealing is performed in the range of 425° C. to 500° C. for 1 h to 10 h.

9. The method according to claim 1, wherein the condition regarding Cu is not satisfied, and therefore the steel satisfies the condition regarding Ni and Al, and the precipitation annealing is performed in the range of 500° C. to 550° C. for more than 1 hr.

* * * * *